US008976208B2

(12) United States Patent
Kim et al.

(10) Patent No.: US 8,976,208 B2
(45) Date of Patent: Mar. 10, 2015

(54) DISPLAY APPARATUS AND DRIVING METHOD THEREOF

(75) Inventors: Jinpil Kim, Suwon-si (KR); Jai-Hyun Koh, Seoul (KR); Se Ah Kwon, Seoul (KR); Heendol Kim, Yongin-si (KR); Kuk-Hwan Ahn, Hwaseong-si (KR); Iksoo Lee, Seoul (KR); Namjae Lim, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 226 days.

(21) Appl. No.: 13/468,534

(22) Filed: May 10, 2012

(65) Prior Publication Data

US 2013/0057600 A1 Mar. 7, 2013

(30) Foreign Application Priority Data

Sep. 6, 2011 (KR) ..... 10-2011-0090354

(51) Int. Cl.

| | |
|---|---|
| ***G09G 5/10*** | (2006.01) |
| ***G09G 3/36*** | (2006.01) |
| *G09G 3/34* | (2006.01) |

(52) U.S. Cl.

CPC ..... *G09G 3/3648* (2013.01); *G09G 3/342* (2013.01); *G09G 3/3607* (2013.01); *G09G 2310/0235* (2013.01); *G09G 2310/024* (2013.01); *G09G 2320/0252* (2013.01); *G09G 2320/0257* (2013.01); *G09G 2340/0435* (2013.01); *G09G 2340/16* (2013.01)

USPC ..... 345/691; 345/50; 345/87

(58) Field of Classification Search

CPC ..... G09G 3/3648; G09G 3/342; G09G 2310/0235; G09G 2320/0252; G09G 2340/0435; G09G 3/3607; G09G 2310/024; G09G 2320/0257; G09G 2340/16

USPC ..... 345/690–691, 208–211, 50–55, 87–95

See application file for complete search history.

(56) References Cited

U.S. PATENT DOCUMENTS

| | | | | |
|---|---|---|---|---|
| 7,148,868 | B2 * | 12/2006 | Lee | 345/87 |
| 7,868,560 | B2 * | 1/2011 | Gong et al. | 315/291 |
| 7,973,783 | B2 * | 7/2011 | Takahashi et al. | 345/211 |
| 8,154,503 | B2 * | 4/2012 | Chung et al. | 345/100 |
| 8,228,437 | B2 * | 7/2012 | Kim et al. | 348/620 |
| 2005/0083289 | A1 * | 4/2005 | Yang | 345/100 |

(Continued)

FOREIGN PATENT DOCUMENTS

| | | |
|---|---|---|
| JP | 2002-287112 | 10/2002 |
| JP | 2007-333890 | 12/2007 |

(Continued)

*Primary Examiner* — Amare Mengistu
*Assistant Examiner* — Vinh Lam
(74) *Attorney, Agent, or Firm* — F. Chau & Associates, LLC

(57) ABSTRACT

A display device which includes pixels, a plurality of gate lines, a plurality of data lines, a gate driver configured to drive the plurality of gate lines, a data driver configured to drive the plurality of data lines, and a timing controller configured to control the gate driver and the data driver. The timing controller receives a first image signal and outputs a second image signal to the data driver. The timing controller sequentially outputs a boosting signal and the first image signal as the second image signal. The boosting signal is based on the first image signal and the previous first image signal.

20 Claims, 14 Drawing Sheets

(56) References Cited

U.S. PATENT DOCUMENTS

| | | | | |
|---|---|---|---|---|
| 2005/0110738 | A1* | 5/2005 | Kim et al. | 345/100 |
| 2008/0036520 | A1* | 2/2008 | Takahashi et al. | 327/333 |
| 2008/0054159 | A1* | 3/2008 | Yu et al. | 250/205 |
| 2009/0002358 | A1* | 1/2009 | Tamura | 345/212 |
| 2009/0103053 | A1* | 4/2009 | Ichikawa et al. | 353/33 |
| 2010/0110064 | A1* | 5/2010 | Choi et al. | 345/213 |
| 2010/0127753 | A1* | 5/2010 | Shim | 327/333 |
| 2010/0164924 | A1* | 7/2010 | Seo et al. | 345/208 |
| 2011/0025923 | A1* | 2/2011 | Tsubata | 348/731 |
| 2011/0050680 | A1* | 3/2011 | Chung et al. | 345/214 |
| 2011/0069045 | A1* | 3/2011 | Huang et al. | 345/204 |
| 2011/0122166 | A1* | 5/2011 | Peng et al. | 345/690 |
| 2011/0164076 | A1* | 7/2011 | Lee | 345/691 |
| 2011/0216058 | A1* | 9/2011 | Oh | 345/213 |
| 2011/0292236 | A1* | 12/2011 | Shiohara | 348/222.1 |
| 2012/0013598 | A1* | 1/2012 | Choe | 345/214 |
| 2012/0113088 | A1* | 5/2012 | Han et al. | 345/212 |

FOREIGN PATENT DOCUMENTS

| | | |
|---|---|---|
| JP | 2010-145645 | 7/2010 |
| KR | 1020070079549 | 8/2007 |

* cited by examiner

Fig. 9

IRGBk-1 →

IRGBk ↓

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | | 16 | 0 | 0 | 0 | 0 | 0 | 0 | 0 | 0 | 0 | 0 | 0 | 0 | 0 | 0 | 0 |
| 32 | 172 | 112 | 32 | 5 | 0 | 0 | 0 | 0 | 0 | 0 | 0 | 0 | 0 | 0 | 0 | 0 | 0 |
| 48 | 191 | 127 | 95 | 48 | 15 | 10 | 5 | 0 | 0 | 0 | 0 | 0 | 0 | 0 | 0 | 0 | 0 |
| 64 | 206 | 162 | 143 | 105 | 64 | 45 | 30 | 15 | 6 | 3 | 0 | 0 | 0 | 0 | 0 | 0 | 0 |
| 80 | 221 | 177 | 165 | 130 | 105 | 80 | 55 | 40 | 21 | 15 | 10 | 5 | 0 | 0 | 0 | 0 | 0 |
| 96 | 226 | 190 | 182 | 155 | 130 | 115 | 96 | 70 | 54 | 40 | 30 | 15 | 7 | 3 | 1 | 0 | 0 |
| 112 | 232 | 205 | 190 | 180 | 160 | 143 | 130 | 112 | 95 | 75 | 55 | 40 | 25 | 13 | 7 | 2 | 0 |
| 128 | 238 | 219 | 205 | 195 | 181 | 170 | 157 | 140 | 128 | 120 | 103 | 95 | 65 | 50 | 35 | 17 | 0 |
| 144 | 242 | 227 | 215 | 206 | 196 | 187 | 179 | 167 | 157 | 144 | 128 | 107 | 92 | 77 | 55 | 33 | 3 |
| 160 | 245 | 231 | 225 | 215 | 210 | 200 | 190 | 183 | 174 | 170 | 160 | 150 | 132 | 118 | 105 | 90 | 20 |
| 176 | 248 | 242 | 231 | 225 | 220 | 215 | 210 | 200 | 195 | 190 | 180 | 176 | 170 | 160 | 150 | 135 | 70 |
| 192 | 251 | 246 | 238 | 234 | 230 | 227 | 225 | 220 | 215 | 207 | 205 | 200 | 192 | 184 | 175 | 165 | 120 |
| 208 | 253 | 248 | 243 | 240 | 237 | 236 | 234 | 232 | 225 | 221 | 218 | 210 | 210 | 208 | 195 | 185 | 165 |
| 224 | 255 | 253 | 247 | 246 | 244 | 243 | 242 | 240 | 235 | 233 | 232 | 231 | 230 | 228 | 224 | 210 | 200 |
| 240 | 255 | 255 | 252 | 251 | 250 | 249 | 248 | 246 | 245 | 244 | 243 | 242 | 241 | 240 | 240 | 240 | 235 |
| 255 | 255 | 255 | 255 | 255 | 255 | 255 | 255 | 255 | 255 | 255 | 255 | 255 | 255 | 255 | 255 | 255 | 255 |

DISPLAY APPARATUS AND DRIVING METHOD THEREOF

CROSS-REFERENCE TO RELATED APPLICATIONS

This application claims priority under 35 U.S.C. §119 to Korean Patent Application No. 10-2011-0090354, filed on Sep. 6, 2011, the disclosure of which is incorporated by reference herein.

BACKGROUND

1. Technical Field

Embodiments of the invention relate to a display device, and more particularly to a display device that is sequentially driven and a driving method thereof 2. Discussion of Related Art A display device such a Liquid Crystal Display (LCD) may be driven using a Hold Type Driving (HTD) scheme. The HTD scheme may be used to display a series of continuous frames including same or similar static or moving images. However, unlike a Cathode Ray Tube (CRT) device that can be implemented in an impulse manner, a display device using the HTD scheme may experience ghosting and have difficulty adequately reproducing colors.

SUMMARY

In an exemplary embodiment of the inventive concept, a display device includes a plurality of pixels (e.g., an array of pixels), a plurality of gate lines, a plurality of data lines, a gate driver configured to drive the plurality of gate lines, a data driver configured to drive the plurality of data lines, and a timing controller configured to control the gate driver and the data driver. The timing controller receives a first image signal and outputs a second image signal to the data driver. The timing controller sequentially outputs a boosting signal and the first image signal as the second image signal. The boosting signal is based on the first image signal and a previous first image signal.

The first image signal may be input to the timing controller in an order of a first color signal, a second color signal, and a third color signal in turn. The timing controller may output a first color boosting signal corresponding to the first color signal, a second color boosting signal corresponding to the second color signal, and a third color boosting signal corresponding to a third color signal.

The timing controller may output as the second image signal the first color boosting signal, the first color signal, the second color boosting signal, the second color signal, the third color boosting signal, and the third color signal sequentially in turn according to an input order of the first color signal, the second color signal, and the third color signal.

The first, second and third color signals may be reddish, bluish and greenish frame signals, respectively.

The timing controller may output the boosting signal to have a gradation level higher than that of the reddish frame signal when the first image signal is the reddish frame signal, the boosting signal to have a gradation level lower than that of the bluish frame signal when the first image signal is the bluish frame signal, and the boosting signal to have a gradation level higher than that of the greenish frame signal when the first image signal is the greenish frame signal.

The timing controller may include a frame memory storing the first image signal. The timing controller may further include a boosting circuit outputting the boosting signal as the second image signal at a current frame and the first image signal as the second image signal at a subsequent frame. In an alternate embodiment, the timing controller includes a boosting circuit outputting as the second image signal a previous first image signal stored in the frame memory and the boosting signal corresponding to the first image signal at an $F^{th}$ frame and as the second image signal the first image signal at a $(F+1)^{th}$ frame.

The boosting circuit may include a lookup table storing the boosting signal addressed by the previous first image signal and the first image signal. The boosting circuit may use the previous first image signal stored in the frame memory and the current first image read the boosting signal from the lookup table. In an alternate embodiment, the boosting circuit may include a lookup table storing the previous first image signal and the boosting signal corresponding to the first image signal and a boosting unit comparing the previous first image signal stored in the frame memory with the first image signal and reading the boosting signal corresponding to the comparison result from the lookup table.

A frequency of the second image signal output from the timing controller may be 360 Hz.

The display device may further include a plurality of light source groups arranged to be opposite the pixels (or an array of the pixels) and corresponding to gate line groups of the plurality of gate lines, respectively. The light source groups may be enabled sequentially, where each of the light source groups is disabled when pixels connected with a corresponding gate line group are driven with a voltage corresponding to the boosting signal by the data driver. The light source groups may be enabled and disabled sequentially every frame.

In an exemplary embodiment of the inventive concept, a method of driving a display device include receiving a current first image signal, acquiring a previous first image signal and a boosting signal corresponding to the previous first image signal and the current first image, outputting the boosting signal as a second image signal for driving pixels, and outputting the current first image signal as the second image signal for driving the pixels.

The driving method may further include storing the previous first image signal in a frame memory. The acquiring of the previous first image signal may include reading the previous first image signal out from the frame memory.

The current first image signal may include a first color signal, a second color signal, and a third color signal that are sequentially input in turn. The first, second and third color signals may be reddish, bluish and greenish frame signals, respectively.

The outputting of the boosting signal may include outputting the boosting signal to have a gradation level higher than that of the reddish frame signal when the current first image signal is the reddish frame signal, outputting the boosting signal to have a gradation level lower than that of the bluish frame signal when the current first image signal is the bluish frame signal; andoutputting the boosting signal to have a gradation level higher than that of the greenish frame signal when the current first image signal is the greenish frame signal.

An output speed of the second image signal may be two times faster than an input speed of the current first image signal.

In an exemplary embodiment of the inventive concept, a display device includes a frame memory configured to store a previous first image signal input during a first period and a boosting circuit configured to receive a current first image signal and the previous first image signal during a second period. Further, the boosting circuit sequentially outputs (i) a boosted image signal based on the current and previous first image signals as a second image signal and (ii) the current first image signal as a subsequent second image signal. The display device further includes a display panel including pixels and a data driver configured to generate data voltages from the second image signal for application to the pixels.

The current first image signal may include a reddish frame signal, a blueish frame signal, and a greenish frame signal that are input sequentially during one of three image frame periods, respectively.

The second image signal may be output during three image frame periods and the subsequent second image signal may be output during a subsequent three image frame periods.

The boosting signal may have a luminance level higher than that of the reddish frame signal when the current first image signal is the reddish frame signal, the boosting signal may have a luminance level lower than that of the blueish frame signal when the current first image signal is the blueish frame signal, and the boosting signal may be a luminance level higher than that of the greenish frame signal when the current first image signal is the greenish frame signal.

BRIEF DESCRIPTION OF THE FIGURES

Embodiments of the invention will become apparent from the following description with reference to the following figures, where like reference numerals refer to like parts throughout the various figures unless otherwise specified.

FIG. 9 is a diagram illustrating an exemplary lookup table that may be used in FIG. 2.

DETAILED DESCRIPTION

The embodiments of the inventive concept are described more fully hereinafter with reference to the accompanying drawings, in which exemplary embodiments of the inventive concept are shown.

Figure 1:
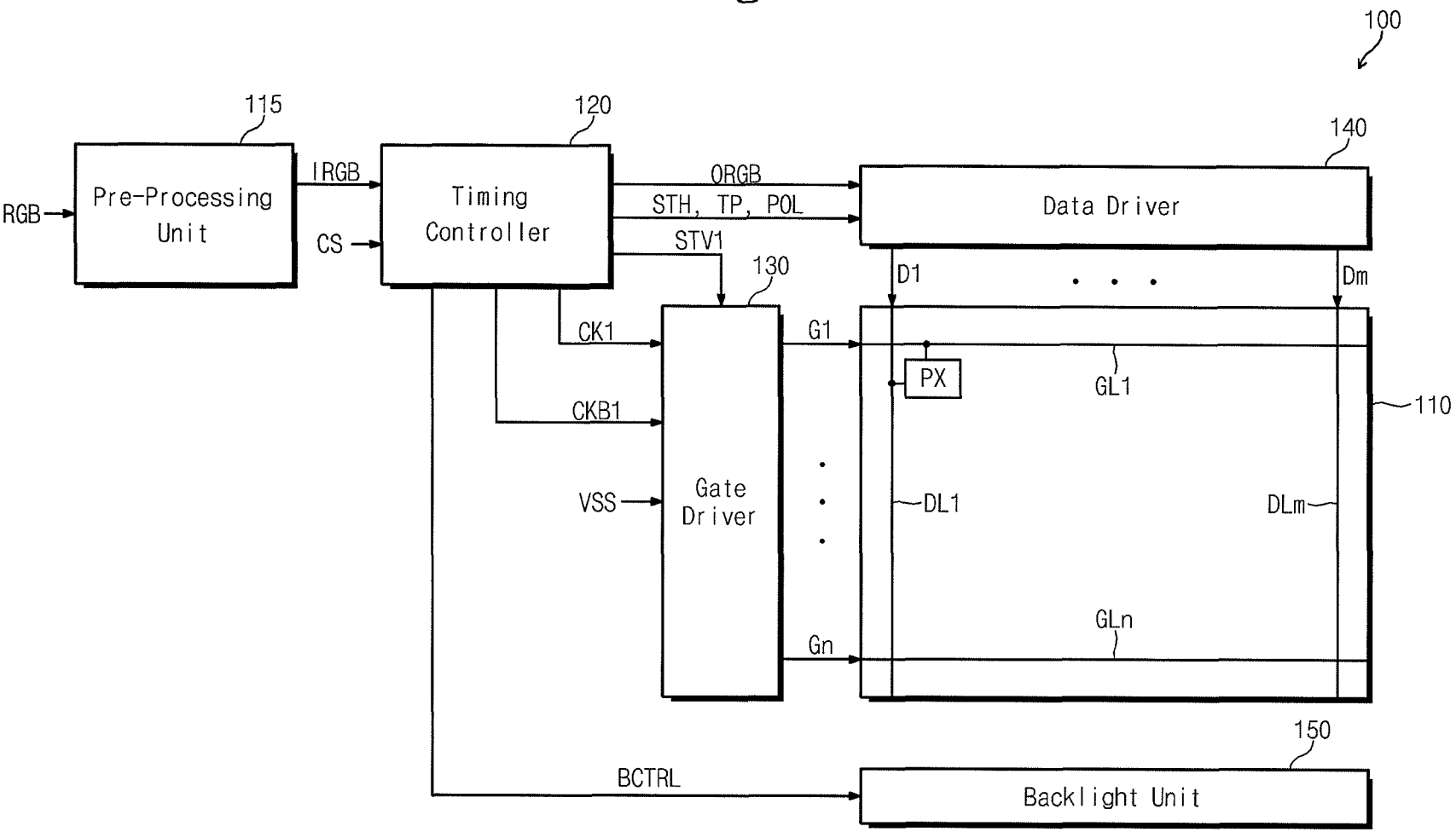
FIG. 1 is a block diagram schematically illustrating a display device according to an exemplary embodiment of the inventive concept.

FIG. 1 is a block diagram schematically illustrating a display device according to an exemplary embodiment of the inventive concept.

Referring to FIG. 1, a display device 100 includes a display panel 110, a pre-processing unit 115, a timing controller 120, a gate driver 130, a data driver 140, and a backlight unit 150.

The pre-processing unit 115 receives an image signal RGB to output a first image signal IRGB. The image signal RGB may be received from an external device. The pre-processing unit 115 may convert an image signal RGB corresponding to a single image frame into the first image signal IRGB that includes three image frames. In one embodiment, a single image frame corresponds to the largest image that can be displayed on the display panel 110 during a given period, and the three image frames correspond to three same or different images of the same size that are successively displayed on the display panel over three periods. In another embodiment, the single image frame corresponds to a smaller image that can be displayed on part of the display panel during a given period, and the three images correspond to three same or different images of the same size that are successively displayed on the display panel over three periods.

The first image signal IRGB may include a reddish frame signal as a first color signal, a bluish frame signal as a second color signal, and a greenish frame signal as a third color signal. The reddish frame signal may be a red sequence signal including a blue gradation, a red gradation, and a green gradation. The bluish frame signal may be a blue sequence signal including a blue gradation, a red gradation, and a green gradation. The greenish frame signal may be a green sequence signal including a blue gradation, a red gradation, and a green gradation. Output of the first image signal IRGB from the pre-processing unit 115 may cause the reddish, bluish and greenish frame signals to be sequentially output in turn every frame. However, in alternate embodiments, the order of the reddish, bluish and greenish frame signals output is changed variously. As discussed above, the pre-processing unit 115 may convert an image signal RGB corresponding to a single frame into a first image signal IRGB that includes three frames. For this reason, if a frequency of the image signal RGB is 60 Hz, the first image signal IRGB may have a frequency of 180 Hz. However, embodiments of the invention are not limited to any particular frequency or multiple thereof. For example, the first image signal IRGB may have a frequency that is greater than three times the frequency of the image signal RGB (e.g., 3.5, 4, etc.)

In an exemplary embodiment of the invention, the first image signal IRGB output from the pre-processing unit 115 includes a reddish frame signal, a bluish frame signal, a greenish frame signal, a red frame signal including a red gradation, a blue frame signal including a blue gradation, and a green frame signal including a green gradation. In another exemplary embodiment of the invention, the first image signal IRGB output from the pre-processing unit 115 is converted into three or more frame signals which are classified on the basis of different references.

In an embodiment, the timing controller 120 receives the first image signal IRGB from the pre-processing unit 115 and a plurality of control signals CS. The timing controller 120 may convert the first image signal IRGB to a data format that is suitable for an interface specification associated with the data driver 140. In an embodiment, the converted image signal is provided to the data driver 140 as a second image signal ORGB. In an embodiment, the timing controller 120 provides data control signals (e.g., an output start signal TP, a horizontal start signal STH, a polarity inversion signal POL, etc.) to the data driver 140 and gate control signals (e.g., a first start signal STV1, a first clock signal CK1, and a second clock signal CKB1) to the gate driver 130.

In an embodiment, the gate driver 130 outputs gate signals G1 through Gn sequentially in response to the gate control signals STV1, CK1, and CKB1 provided from the timing controller 120.

The data driver 140 may convert the second image signal ORGB into data voltages D1 through Dm in response to the data control signals TP, STH, and POL provided from the timing controller 120. In an embodiment, the data voltages D1 through Dm are applied to the display panel 110.

In an embodiment, the display panel 110 includes a plurality of data lines DL1 through DLm supplied with the data voltages D1 through Dm, a plurality of gate lines GL1 through GLn supplied with the gate signals G1 through Gn, and a plurality of pixels PX. The pixels may be arranged at intersections of the plurality of data lines DL1 through DLm and the plurality of gate lines GL1 through GLn. Each of the pixels PX may have the same structure.

Although not shown in figures, each pixel PX may include a thin film transistor and a pixel electrode. In an embodiment, a gate electrode of the thin film transistor is connected with a corresponding one of the plurality of gate lines GL1 through GLn, its source electrode is connected to a corresponding one of the plurality of data lines DL1 through DLm, and its drain electrode is connected to the pixel electrode.

In an embodiment, the plurality of gate lines GL1 through GLn are connected to the gate driver 130, and the plurality of data lines DL1 through GLm are connected to the data driver 140. In an embodiment, the plurality of gate lines GL1 through GLn receive the gate signals G1 through Gn provided from the gate driver 130, and the plurality of data lines DL1 through DLm receive the data voltages D1 through Dm provided from the data driver 140.

Accordingly, a thin film transistor of each pixel PX is turned on in response to a gate signal supplied to a corresponding gate line, and a data voltage supplied to a corresponding data line is applied to a pixel electrode via the turned-on thin film transistor.

Figure 2:
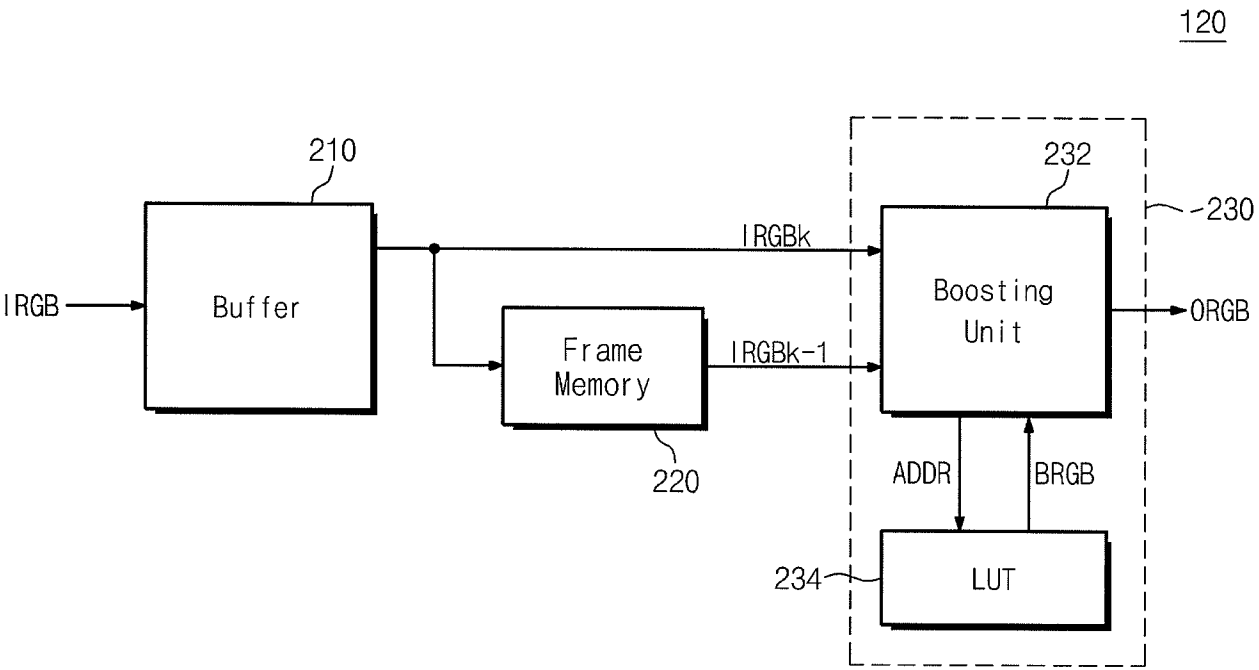
FIG. 2 is a timing controller schematically illustrating a timing controller in FIG. 1 according to an exemplary embodiment of the inventive concept.

FIG. 2 is a timing controller schematically illustrating a timing controller in FIG. 1 according to an exemplary embodiment of the invention.

Referring to FIG. 2, a timing controller 120 includes a buffer 210, a frame memory 220, and a boosting circuit 230.

In an embodiment, the buffer 210 buffers a first image signal IRGB input from an external source. In an embodiment, the frame memory 220 stores a current image signal IRGBk output from the buffer 210. The boosting circuit 230 may include a boosting unit 232 and a lookup table 234. In an embodiment, the boosting unit 230 reads out from the lookup table, a boosting signal BRGB corresponding to a previous image signal IRGBk-1 stored in the frame memory 220 and a current image signal IRGBk provided from the buffer 210. For example, the previous image signal IRGBk-1 may have been stored in the frame memory 220 at time t0 and the current image signal IRGBk may have been stored in or output from the buffer 210 at a later time t1. The boosting unit 232 may read out a boosting signal BRGB stored at a location of the lookup table 234 designated by an address ADDR corresponding to the previous image signal IRGBk-1 and the current image signal IRGBk. For example, the boosting signal BRGB may be determined by indexing a row of the lookup table 234 assigned with a luminance of the current image signal IRGBk and a column of the lookup table 234 assigned with a luminance of the previous image signal IRGBk-1.

At an $F^{th}$ frame (e.g., where F is a positive integer), the boosting unit 232 may read a boosting signal BRGB corresponding to a previous image signal IRGBk-1 stored in the frame memory 220 and a current image signal IRGBk provided from the buffer 210 from the lookup table 234 to output the boosting signal BRBG as a second image signal ORGB. At an $(F+1)^{th}$ frame, the boosting unit 232 may output the current image signal IRGBk as the second image signal ORGB. For example, the $F^{th}$ frame may be an odd frame, and the $(F+1)^{th}$ frame may be an even frame.

In an embodiment, the timing controller 120 outputs the second image signal ORGB of 360 Hz in response to input of the first image signal IRGB of 180 Hz. For example, if a frame of the first image signal IRGB is input, the timing controller 120 may sequentially output the boosting signal BRGB at the $F^{th}$ frame and the current first image signal IRGBk provided from the buffer 210 at the $(F+1)^{th}$ frame. The second image signal ORGB output from the timing controller 120 may have a frequency (e.g., of 360 Hz), which is two times larger than a frequency (e.g., 180 Hz) of the first image signal IRGB. In an alternate embodiment, the second image signal ORGB output from the timing controller 120 has a frequency that is greater than twice the frequency of the first image signal IRGB.

In the present embodiment, the timing controller 120 includes the buffer 210. However, in an alternate embodiment, the timing controller 120 does not include the buffer 210. In this embodiment, the first image signal IRGB output from a pre-processing unit 115 is directly provided to the frame memory 220 and the boosting unit 232 as a current first image signal IRGBk.

Figure 3:
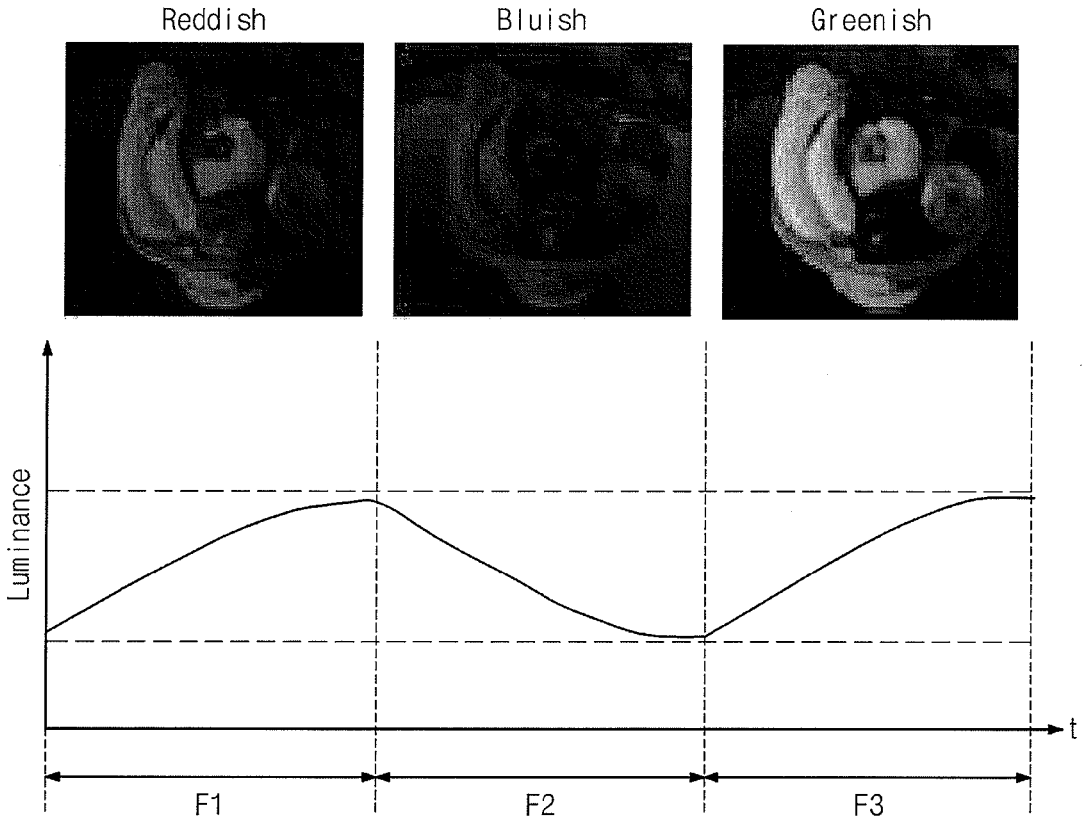
FIG. 3 is a diagram illustrating an exemplary first image signal that may be input to a timing controller in FIG. 2.

FIG. 3 is a diagram illustrating an exemplary first image signal that may be input to a timing controller in FIG. 2 according to an exemplary embodiment of the invention.

Referring to FIG. 3, in an embodiment, a reddish frame signal, a bluish frame signal and a greenish frame signal output from a pre-processing unit 115 are provided to a timing controller 120 in turn sequentially every frame. For example, the reddish frame signal may be provided to the timing controller 120 at a first frame F1, the bluish frame signal may be provided to the timing controller 120 at a second frame F2, and the greenish frame signal may be provided to the timing controller 120 at a third frame F3. However, the output order of the reddish frame signal, the bluish frame signal, and the greenish frame signal may be changed variously. In an embodiment, a color that is reddish is caused by mixing or tingeing a color other than red with red (e.g., reddish brown), a color that is blueish is caused by mixing or tingeing a color other than blue with blue (e.g., blueish white), and a color that is greenish is caused by mixing or tingeing a color other than green with green (e.g., greenish yellow).

The reddish frame signal may be a red sequence signal including a blue gradation, a red gradation, and a green gradation. The bluish frame signal may be a blue sequence signal including a blue gradation, a red gradation, and a green gradation. The greenish frame signal may be a green sequence signal including a blue gradation, a red gradation, and a green gradation.

As compared with a hold type driving scheme where substantially identical image signals are input continuously, persistence of vision and color reproduction may be improved by using a field sequential driving manner where a reddish frame signal, a bluish frame signal and a greenish frame signal are sequentially input every frame.

However, in an example where a bluish frame signal is input following an input of a reddish frame signal, a variation in luminance of a color signal may be large. In this example, color mix may occur due to a response speed of a liquid crystal capacitor (not shown) within a pixel PX in FIG. 1.

Figure 4:
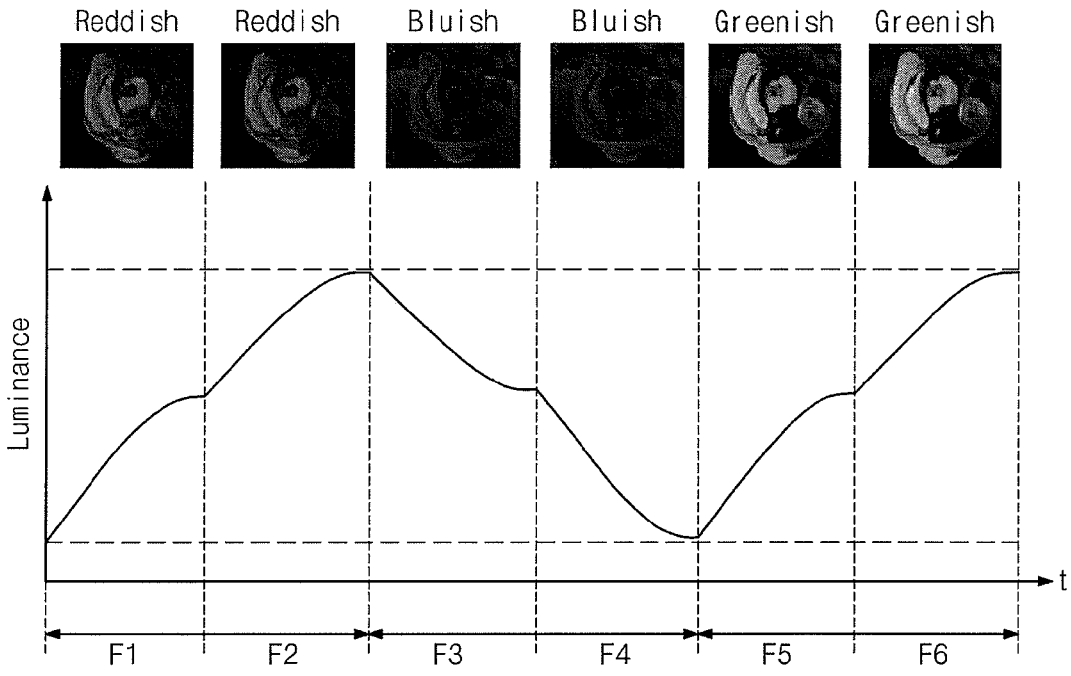
FIG. 4 is a diagram illustrating an exemplary second image signal that may be output from a timing controller in FIG. 2.

FIG. 4 is a diagram illustrating an exemplary second image signal that may be output from a timing controller in FIG. 2 according to an exemplary embodiment of the invention.

Referring to FIG. 4, a timing controller 120 outputs the same color signal twice. For example, the timing controller 120 outputs the reddish frame signal during the first two frame periods F1 and F2, outputs the bluish frame signal during the next two frame periods F3 and F4, and outputs the greenish frame signal during the last two frame periods F5 and F6. Further, in alternate embodiments, the reddish, bluish, and greenish frame signals are output in a different order. A second image signal ORGB may be output at a speed two times faster than that of a first image signal IRGB. For example, when the first image signal IRGB has a frequency of 180 Hz, the second image signal ORGB may have a frequency of 360 Hz. In an alternate embodiment, the first image signal IGRB is output at a speed that is greater than two times faster than the first image signal IRGB.

Figure 5:
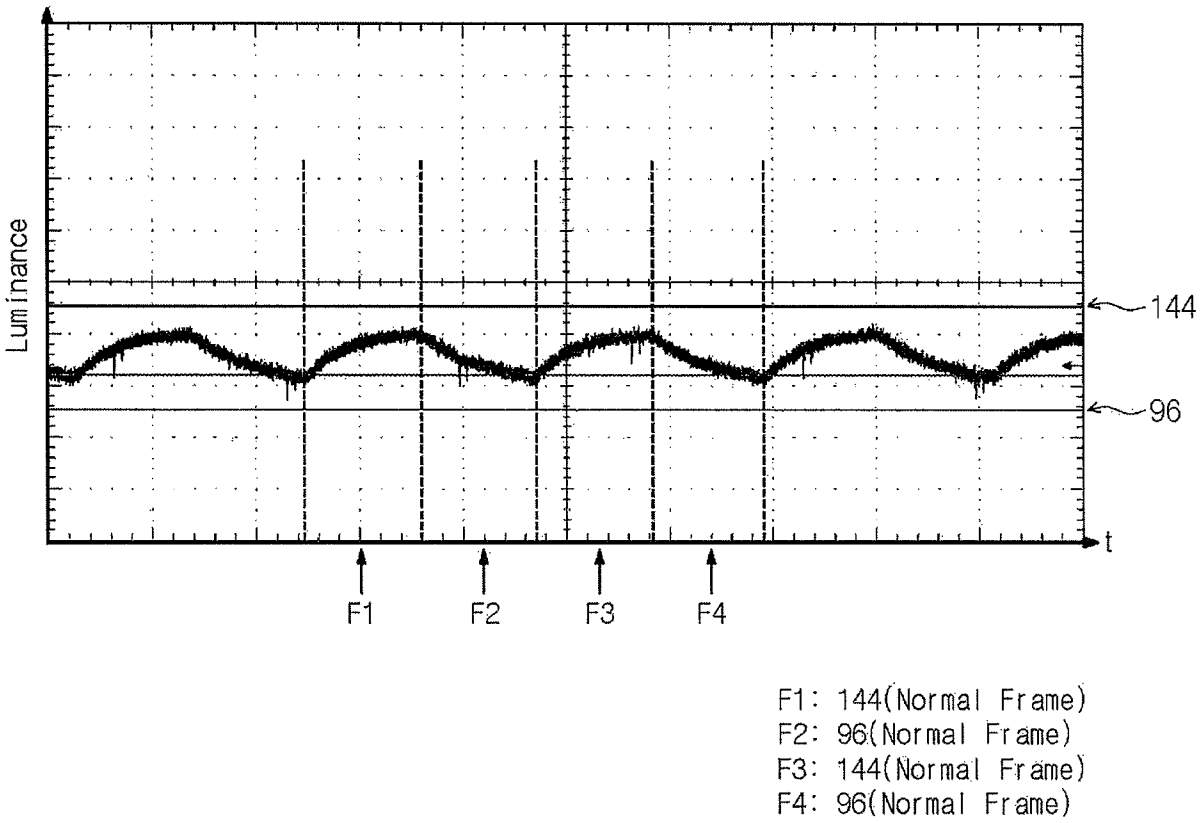
FIGS. 5 and 6 are diagrams illustrating an exemplary second image signal according to an operation of a timing controller in FIG. 2.
Figure 6:
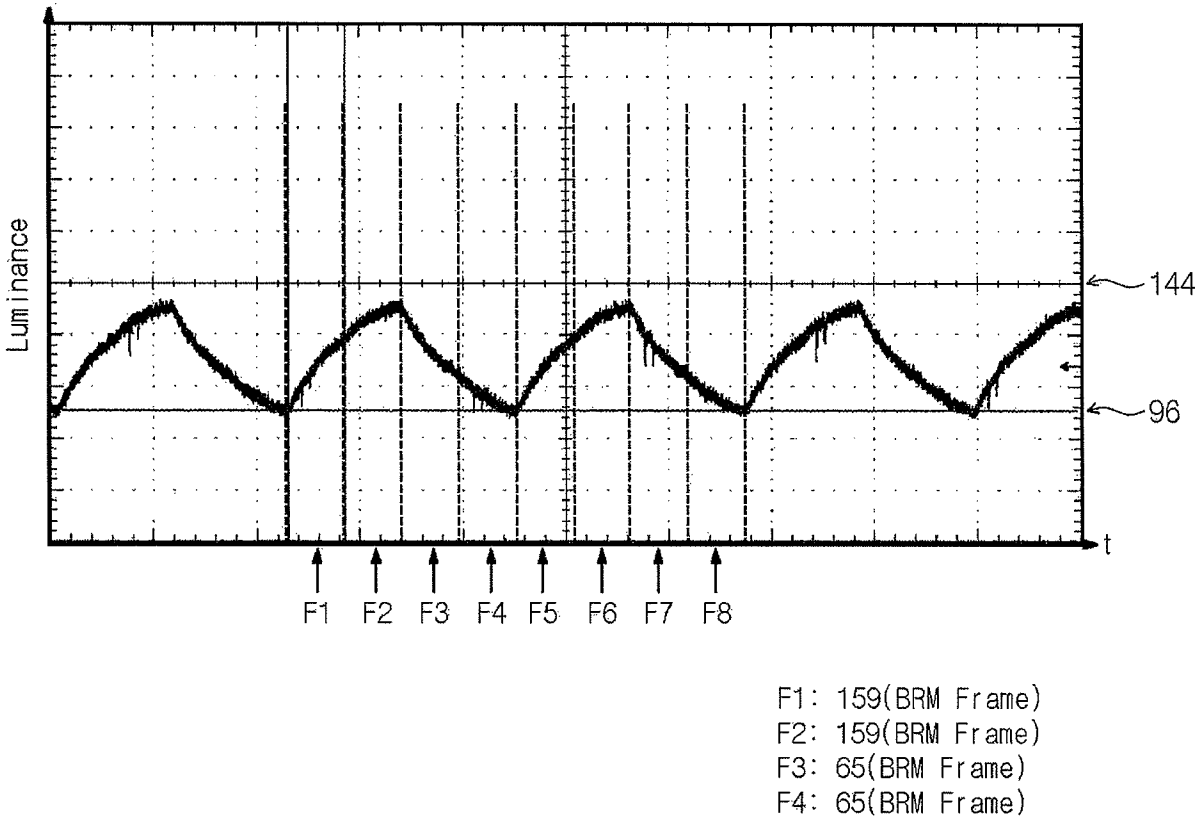

FIGS. 5 and 6 are diagrams of an exemplary second image signal according to an operation of a timing controller in FIG. 2.

FIG. 5 shows a second image signal ORGB when a boosting unit 232 of a timing controller 120 outputs a first image signal IRGB as a second image signal ORGB without modification.

In this embodiment, it is assumed that the first image signal IRGB includes a reddish frame signal and a bluish frame signal, a luminance level of an input reddish frame signal is 144, and a luminance level of an input bluish frame signal is 96. In an embodiment, the reddish frame signal and the bluish frame signal are provided to a timing controller 120 sequentially in turn every frame, and the timing controller 120 directly outputs the reddish frame signal and the bluish frame signal as the second image signal ORGB. For example, a luminance level of the second image signal ORGB output from the timing controller 120 may be measured to be lower than that of the input reddish frame signal (e.g., 144) and to be higher than that of the input bluish frame signal (e.g., 96). When the second image signal ORGB is displayed by the display panel 110, it may be displayed with a luminance that is lower or higher than a desired luminance. The difference in luminance may be caused by a slow response speed of each pixel PX.

FIG. 6 shows an exemplary second image signal ORGB when a boosting unit 232 of a timing controller 120 boosts a first image signal IRGB to output it as a second image signal ORGB.

The boosting unit 232 may boost the first image signal IRGB every frame. In this embodiment, it is assumed that the first image signal IRGB includes a reddish frame signal and a bluish frame signal, a luminance level of an input reddish frame signal is 144, and a luminance level of an input bluish frame signal is 96. The boosting unit 232 may increase a luminance level of the input reddish frame signal to 159 (e.g., overshoot boosting) and decrease a luminance level of the input bluish frame signal to 65 (e.g., undershoot boosting). The boosting unit 232 may output the second image signal ORGB at a speed two times faster than that of the first image signal IRGB. A frame where the second image signal ORGB is output overshoot boosted or undershoot boosted may be referred to as a Boosting Response Method (BRM) frame.

As a result, the second image signal ORGB output from the timing controller 120 may be close to a luminance level of an input reddish frame signal (e.g., 144) and a luminance level of an input bluish frame signal (e.g., 96).

Use of the above-described Boosting Response Method (BRM) may improve display luminance and reduce a color mix phenomenon.

Figure 7:
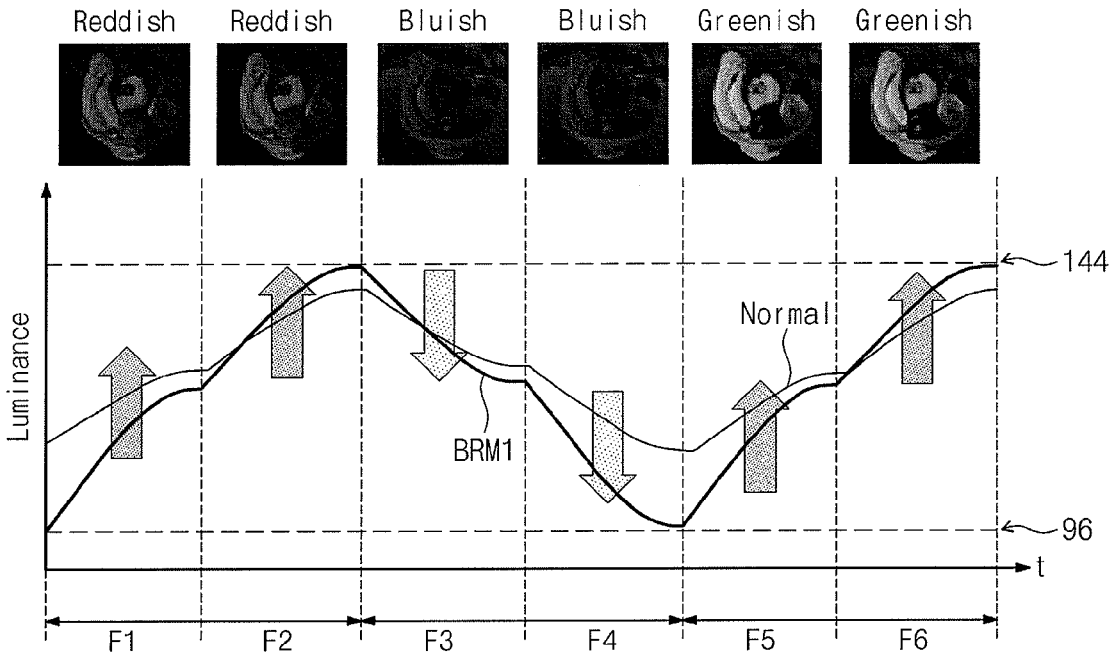
FIG. 7 is a diagram illustrating exemplary second image signals when a timing controller in FIG. 2 operates in a normal mode and in a first boosting mode.

FIG. 7 is a diagram illustrating exemplary second image signals when a timing controller in FIG. 2 operates at a normal mode and at a first boosting mode.

Referring to FIG. 7, a timing controller 120 in FIG. 2 outputs a second image signal ORGB at a speed two times greater than that of a first image signal IRGB. For example, the timing controller 120 operates in a normal mode, in which the first image signal IRGB is directly output as the second image signal ORGB, and in a first boosting mode BRM1 in which the first image signal IRGB is boosted and then the boosted signal is output as the second image signal ORGB. As compared with the example where the timing controller 120 operates in the normal mode, the second image signal ORGB may be close to a luminance level of an input reddish frame signal (e.g., 144) and a luminance level (of an input bluish frame signal (e.g., 96) when the timing controller 120 operates at the first boosting mode BRM1.

Figure 8:
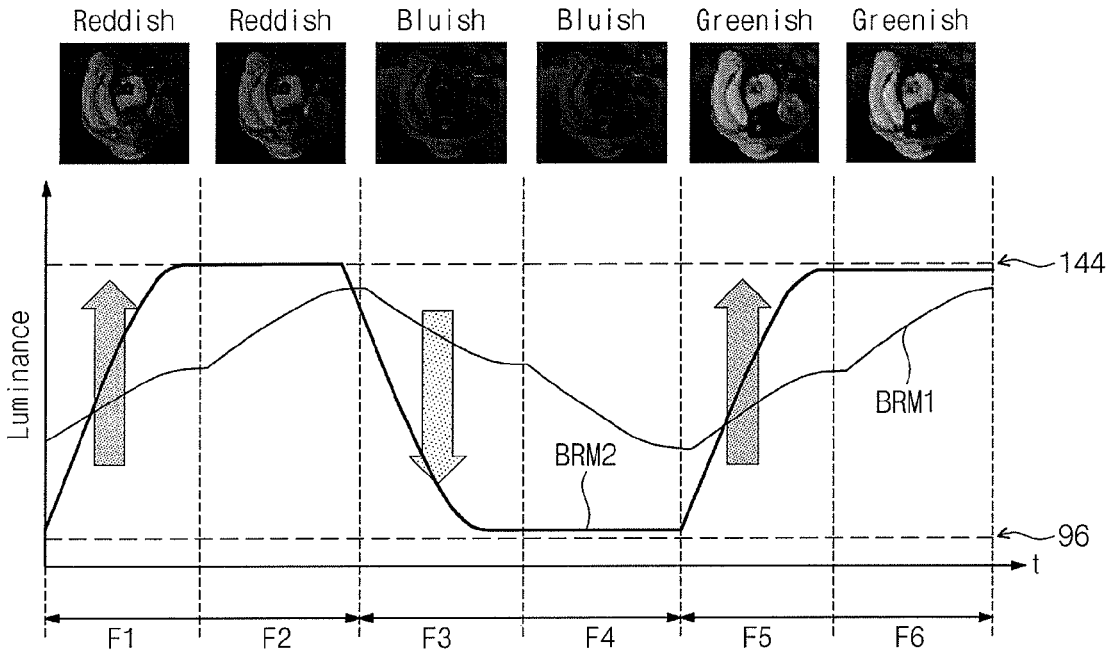
FIG. 8 is a diagram illustrating exemplary second image signals when a timing controller in FIG. 2 operates in a first boosting mode and a second boosting mode.

FIG. 8 is a diagram illustrating exemplary second image signals when a timing controller in FIG. 2 operates at a first boosting mode and a second boosting mode.

Referring to FIG. 8, a timing controller 120 in FIG. 2 may output a second image signal ORGB at a speed two times greater than that of a first image signal IRGB. For example, the timing controller 120 may operate in first and second boosting modes BRM1 and BRM2 in which the first image signal IRGB is boosted and then the boosted signal is output as the second image signal ORGB.

In an embodiment, during the second boosting mode BRM2, a boosting unit 232 reads a boosting signal BRGB corresponding to a previous image signal IRGBk-1 stored in a frame memory 220 and a current image signal IRGBk provided from a buffer 210, from a lookup table 234. The boosting unit 232 may read out from the lookup table 234, a boosting signal BRGB stored at a location of the lookup table 234 designated by an address ADDR corresponding to the previous image signal IRGBk-1 and the current image signal IRGBk. A boosting signal BRGB stored in the lookup table 234 may have a luminance level, which is boosted to a value that is higher than that at the first boosting mode BRM1.

FIG. 9 is a diagram illustrating an exemplary lookup table that may be used in FIG. 2.

Referring to FIG. 9, in an example where a luminance level of a first image signal IRGBk-1 of a previous frame is 96 and a luminance level of a first image signal IRGBk of a current frame is 144, a boosting signal BRGB read out from a lookup table 234 of a boosting unit 232 may have a luminance level of 179, which is higher than a luminance level in a first boosting mode BRM1 (e.g., 144).

In an example where a luminance level of a first image signal IRGBk-1 of a previous frame is 144 and a luminance level of a first image signal IRGBk of a current frame is 96, a boosting signal BRGB read out from the lookup table 234 of the boosting unit 232 may have a luminance level of 40, which is lower than a luminance level in the first boosting mode BRM1 (e.g., 96).

Referring to FIG. 8, as compared with the example where the timing controller 120 operates in the first boosting mode, the second image signal ORGB may be close to a luminance level of an input reddish frame signal (e.g., 144) and a luminance level (of an input bluish frame signal (e.g., 96) when the timing controller 120 operates at the second boosting mode BRM2.

Figure 10:
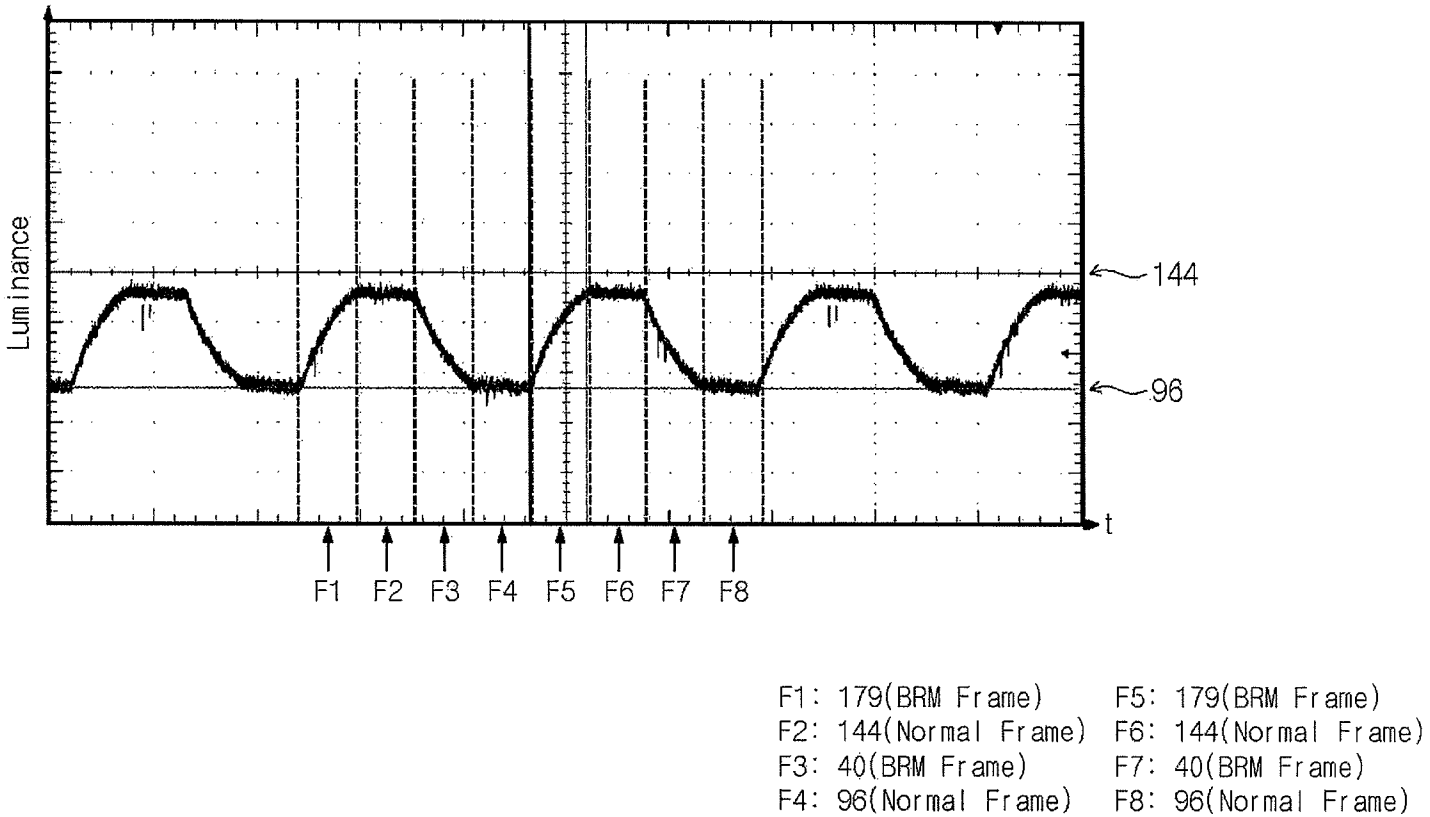
FIG. 10 is a diagram illustrating an exemplary second image signal when a timing controller in FIG. 2 operates at a second boosting mode.

FIG. 10 is a diagram illustrating an exemplary second image signal when a timing controller in FIG. 2 operates in a second boosting mode.

Referring to FIG. 10, a boosting unit 232 in FIG. 2 may sequentially output a boosting signal of a first image signal IRGB and the first image signal IRGB in a second boosting mode BRM2. In this embodiment, it is assumed that the first image signal IRGB includes a reddish frame signal and a bluish frame signal, a luminance level of an input reddish frame signal is 144, and a luminance level of an input bluish frame signal is 96. A boosting unit 232 may read out from a lookup table 234, a boosting signal BRGB corresponding to a current image signal IRGBk provided from a buffer 210 and a previous image signal IRGBk-1 provided from a frame memory 220. If a currently input reddish frame signal has a luminance level of 144 and a currently input bluish frame signal has a luminance level of 96, the boosting signal BRGB may have a luminance level of 179. If a currently input reddish frame signal has a luminance level of 96 and a currently input bluish frame signal has a luminance level of 144, the boosting signal BRGB may have a luminance level of 40. At first through eighth frames F1 through F8, luminance levels of second image signals ORGB output from a timing controller 120 may be 179, 144, 40, 96, 179, 144, 40, and 96, respectively. A frame in which a second image signal ORGB is output undershoot boosted or overshoot boosted may be referred to as a BRM frame, and a frame in which a first image signal IRGB is output as a second image signal ORGB may be referred to as a normal frame.

As a result, the second image signal ORGB output from the timing controller 120 may be close to a luminance level (e.g., 144) of an input reddish frame signal (e.g., 144) and a luminance level of an input bluish frame signal (e.g., 96).

Figure 11:
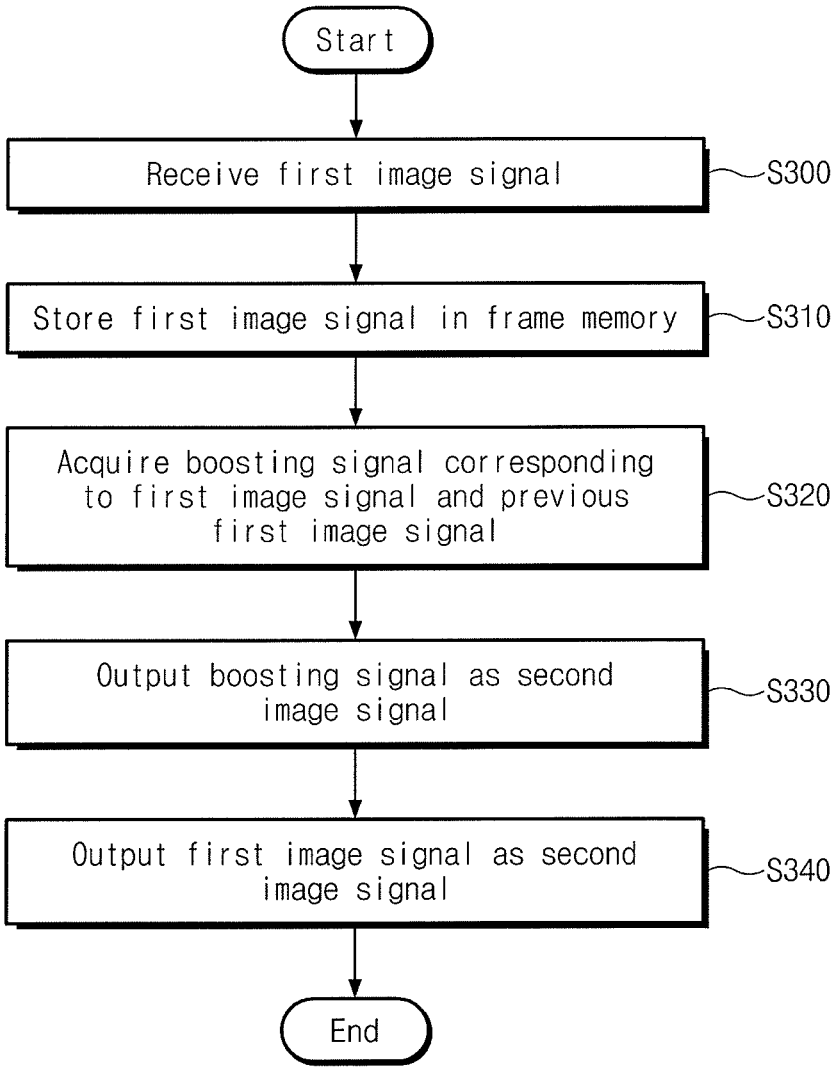
FIG. 11 is a flowchart for describing an operation of a timing controller in FIG. 2 according to an exemplary embodiment of the invention.

FIG. 11 is a flowchart for describing an operation of a timing controller in FIG. 2 according to an exemplary embodiment of the invention.

Referring to FIGS. 2 and 11, in operation S300, a timing controller 120 receives a first image signal IRGB. In operation S310, a first image signal IRGBk of a $k^{th}$ frame is provided to a boosting unit 232 and stored in a frame memory 220.

In operation S320, the boosting unit 232 reads out from a lookup table 234, a boosting signal BRGB corresponding to a first image signal IRGBk of a current frame (e.g., the $k^{th}$ frame) and a previous first image signal IRGBk-1 of a previous frame read out from the frame memory 220 (e.g., a $(k-1)^{th}$ frame).

In operation S330, the boosting unit 232 outputs the readout boosting signal BRGB as a second image signal ORGB. In operation S340, the boosting unit 232 outputs a first image signal IRGBk of the $k^{th}$ frame as the second image signal ORGB.

The first image signal IRGB may include a reddish frame signal, a bluish frame signal, and a greenish frame signal, and an order of the reddish frame signal, the bluish frame signal, and the greenish frame signal may be changed variously.

In an embodiment, the lookup table 234 stores a boosting signal BRGB to have a gradation level higher than that of a reddish frame signal input when a first image signal IRGB is a reddish frame signal. The lookup table 234 may output a boosting signal BRGB to have a gradation level lower than that of a bluish frame signal input when the first image signal IRGB is a bluish frame signal. The lookup table 234 may store a boosting signal BRGB to have a gradation level higher than that of a greenish frame signal input when the first image signal IRGB is a greenish frame signal.

Figure 12:
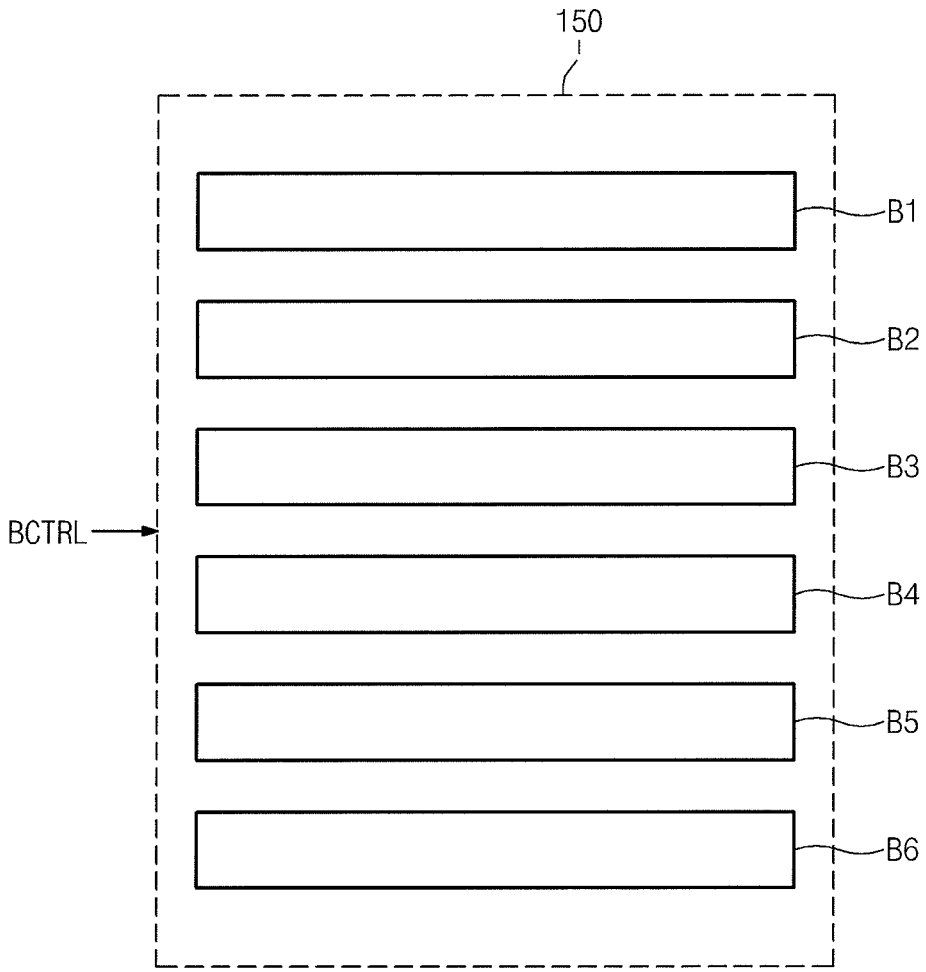
FIG. 12 is a block diagram schematically illustrating an example of a backlight unit that may be used in FIG. 1.

FIG. 12 is a block diagram schematically illustrating an example of a backlight unit that may be used in FIG. 1.

As discussed above, the display device 100 illustrated in FIG. 1 includes a backlight unit 150. The backlight 150 unit may be located at a lower part of the liquid crystal panel 110 and arranged to opposite the pixels.

Referring to FIG. 12, the backlight unit 150 includes a plurality of light generating blocks B1 through B6. Although not shown in FIG. 12, each of the light generating blocks B1 through B6 may include a plurality of red light emitting units, a plurality of green light emitting units, and a plurality of blue light emitting units.

The light generating blocks B1 through B6 may be driven sequentially in response to a backlight control signal BCTRL provided from a timing controller 120. In an example where a plurality of gate lines G1 through Gn of a liquid crystal panel 110 is divided into six gate line groups, the light generating blocks B1 through B6 may correspond to the gate line groups, respectively.

Figure 13:
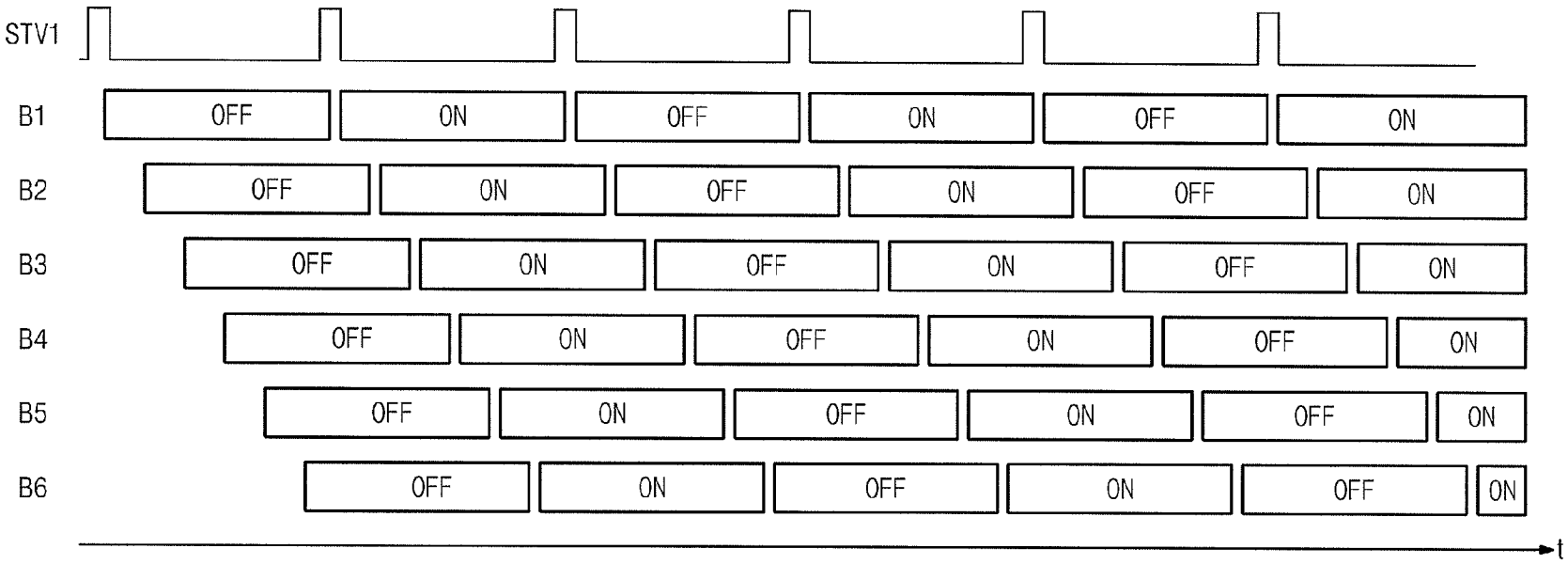
FIG. 13 is a diagram illustrating an example where light generating blocks are turned on/off sequentially.
Figure 14:
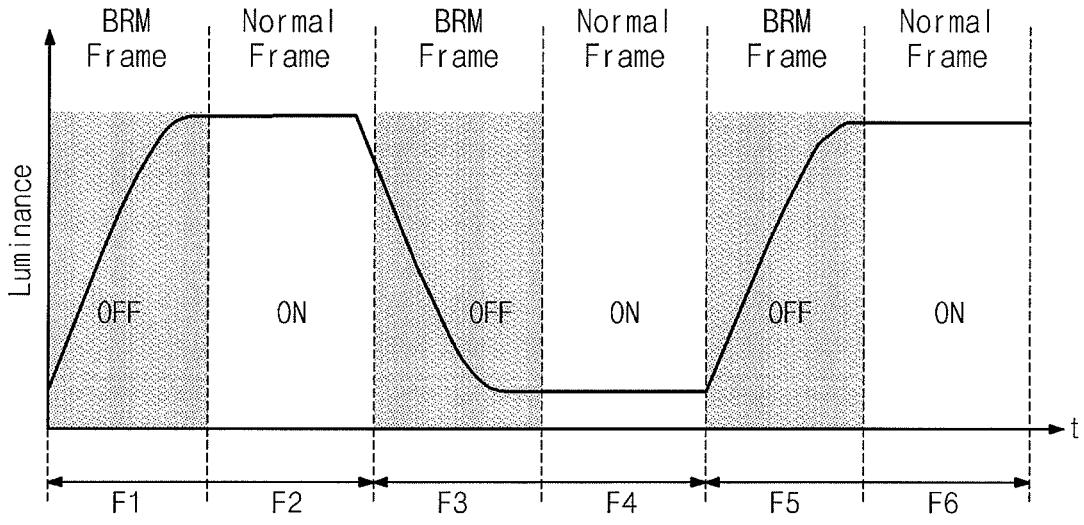
FIG. 14 is a diagram for describing an on/off state of a light generating block corresponding to a predetermined pixel at a frame according to an exemplary embodiment of the invention and a normal frame.

FIG. 13 is a diagram illustrating an example where light generating blocks are turned on/off sequentially, and FIG. 14 is a diagram that is used for describing an on/off state of a light generating block corresponding to a predetermined pixel at a BRM frame and a normal frame.

Referring to FIGS. 13 and 14, first through six light generating blocks B1 through B6 may be turned on when pixels PX connected with a first gate line within a corresponding gate line group are driven by a boosting signal BRGB, and may be turned off when pixels PX connected with the last gate line are driven by a first image signal IRGB.

Since a corresponding light generating unit is turned off during a BRM frame, a color mix phenomenon where an image signal of a previous frame appears as an afterimage at a current frame may be minimized.

Although exemplary embodiments of the present invention have been shown and described, it will be appreciated that various changes may be made in these embodiments without departing from the spirit and scope of the disclosure.

What is claimed is:

1. A display device comprising:

a plurality of pixels;

a plurality of gate lines;

a plurality of data lines;

a gate driver configured to drive the plurality of gate lines;

a data driver configured to drive the plurality of data lines; and a timing controller configured to control the gate driver and the data driver, wherein the timing controller receives a first image signal and outputs a second image signal to the data driver, and wherein the timing controller sequentially outputs a boosting signal at a current frame as the second image signal, and outputs the first image signal at a subsequent frame as the second image signal, wherein the boosting signal is based on the first image signal and a previous first image signal, and a frequency of the second image signal is higher than a frequency of the first image signal.

2. The display device of claim 1, wherein the first image signal is input to the timing controller in an order of a first color signal, a second color signal, and a third color signal in turn, and wherein the timing controller outputs a first color boosting signal corresponding to the first color signal, a second color boosting signal corresponding to the second color signal, and a third color boosting signal corresponding to a third color signal.

3. The display device of claim 2, wherein the timing controller outputs as the second image signal the first color boosting signal, the first color signal, the second color boosting signal, the second color signal, the third color boosting signal, and the third color signal sequentially in turn according to an input order of the first color signal, the second color signal, and the third color signal.

4. The display device of claim 2, wherein the first, second and third color signals are reddish, bluish and greenish frame signals, respectively.

5. The display device of claim 4, wherein the timing controller outputs the boosting signal to have a gradation level higher than that of the reddish frame signal when the first image signal is the reddish frame signal, the boosting signal to have a gradation level lower than that of the bluish frame signal when the first image signal is the bluish frame signal, and the boosting signal to have a gradation level higher than that of the greenish frame signal when the first image signal is the greenish frame signal.

6. The display device of claim 1, wherein the timing controller comprises:

a frame memory configured to store the first image signal; and a boosting circuit outputting the boosting signal as the second image signal at the current frame and the first image signal as the second image signal at the subsequent frame.

7. The display device of claim 6, wherein the boosting circuit comprises:

a lookup table configured to store the boosting signal addressed by the previous first image signal and the first image signal; and a boosting unit using the previous first image signal stored in the frame memory and the current first image signal to read the boosting signal from the lookup table.

8. The display device of claim 1, wherein a frequency of the second image signal output from the timing controller is 360 Hz.

9. The display device of claim 1, further comprising:

a plurality of light source groups arranged opposite the pixels and corresponding to gate line groups of the plurality of gate lines, respectively, wherein the light source groups are enabled sequentially, and wherein each of the light source groups is disabled when pixels connected with a corresponding gate line group are driven with a voltage corresponding to the boosting signal by the data driver.

10. The display device of claim 9, wherein the light source groups are enabled and disabled sequentially every frame.

11. A driving method of a display device comprising:

receiving a current first image signal;

acquiring a previous first image signal and a boosting signal based on the previous first image signal and the current first image;

outputting the boosting signal at a current frame to a data driver as a second image signal for driving pixels; and outputting the current first image signal at a subsequent frame to the data driver as the second image signal for driving the pixels, wherein a frequency of the second image signal is higher than a frequency of the first image signal.

12. The driving method of claim 11, further comprising:

storing the previous first image signal in a frame memory, wherein the acquiring of the previous first image signal comprising reading the previous first image signal out from the frame memory.

13. The driving method of claim 11, wherein the current first image signal includes a first color signal, a second color signal, and a third color signal that are sequentially input in turn.

14. The driving method of claim 13, wherein the first, second and third color signals are reddish, bluish and greenish frame signals, respectively.

15. The driving method of claim 14, wherein outputting the boosting signal comprises:

outputting the boosting signal to have a gradation level higher than that of the reddish frame signal when the current first image signal is the reddish frame signal;

outputting the boosting signal to have a gradation level lower than that of the bluish frame signal when the current first image signal is the bluish frame signal; and outputting the boosting signal to have a gradation level higher than that of the greenish frame signal when the current first image signal is the greenish frame signal.

16. The driving method of claim 11, wherein an output speed of the second image signal is two times faster than an input speed of the current first image signal.

17. A display device comprising:

a frame memory configured to store a previous first image signal input during a first period;

a boosting circuit configured to receive a current first image signal and the previous first image signal during a second period, and to sequentially output (i) a boosted image signal at a current frame to a data driver based on the current and previous first image signals as a second image signal and (ii) the current first image signal at a subsequent frame to the data driver as a subsequent second image signal;

a display panel including pixels; and the data driver configured to generate data voltages from the second image signal for application to the pixels, wherein a frequency of the second image signal is higher than a frequency of the first image signal.

18. The display device of claim 17, wherein the current first image signal includes a reddish frame signal, a bluish frame signal, and a greenish frame signal that are input sequentially during one of three image frame periods, respectively.

19. The display device of claim 18, wherein the second image signal is output during three image frame periods and the subsequent second image signal is output during a subsequent three image frame periods.

20. The display device of claim 18, wherein the boosting signal has a luminance level higher than that of the reddish frame signal when the current first image signal is the reddish frame signal, the boosting signal has a luminance level lower than that of the bluish frame signal when the current first image signal is the bluish frame signal, and the boosting signal has a luminance level higher than that of the greenish frame signal when the current first image signal is the greenish frame signal.

* * * * *